United States Patent [19]

Wallace

[11] Patent Number: 4,891,244

[45] Date of Patent: Jan. 2, 1990

[54] METHOD AND APPARATUS FOR MAKING SELF-LOCKING FASTENERS

[75] Inventor: Richard B. Wallace, Bloomfield Hills, Mich.

[73] Assignee: The Oakland Corporation, Troy, Mich.

[21] Appl. No.: 312,216

[22] Filed: Feb. 21, 1989

[51] Int. Cl.[4] ..... B05C 19/00; B05D 3/00

[52] U.S. Cl. ..... 427/195; 10/10 P; 118/308; 118/DIG. 16; 427/240

[58] Field of Search ..... 10/10 R, 10 P; 118/308, 118/DIG. 16; 427/195, 240

[56] References Cited

U.S. PATENT DOCUMENTS

| | | | |
|---|---|---|---|
| 3,428,044 | 2/1969 | Whitehead et al. | 427/240 X |
| 3,579,684 | 5/1971 | Duffy | 10/10 P |
| 4,132,815 | 1/1979 | Cadwallader | 427/195 X |
| 4,285,378 | 8/1981 | Wallace | 427/195 X |
| 4,508,759 | 4/1985 | Wallace | 427/195 |
| 4,545,712 | 10/1985 | Wallace | 411/258 |
| 4,800,102 | 1/1989 | Takada | 118/308 X |

FOREIGN PATENT DOCUMENTS

| | | | |
|---|---|---|---|
| 84844 | 3/1957 | Netherlands | 427/240 |

*Primary Examiner*—E. Michael Combs

*Attorney, Agent, or Firm*—Barnes, Kisselle, Raisch, Choate, Whittemore & Hulbert

[57] ABSTRACT

A method of making locking threaded fasteners having on the threaded surfaces thereof locking patch material formed by the accumulation of fused thermoplastic resin particles. The fasteners are advanced through a heating zone followed by an application zone. The fasteners are heated while in the heating zone to a temperature sufficient to fuse thermoplastic resin particles received on the threaded surfaces in the application zone. Thermoplastic resin particles are applied to the fasteners in the application zone by a mechanical propelling device which comprises a rotatable slinger that propels the particles by centrifugal force against the heated threaded surfaces. The thermoplastic resin particles build up on the threaded surfaces and fuse into locking patches. Apparatus for carrying out the method is also disclosed.

5 Claims, 2 Drawing Sheets

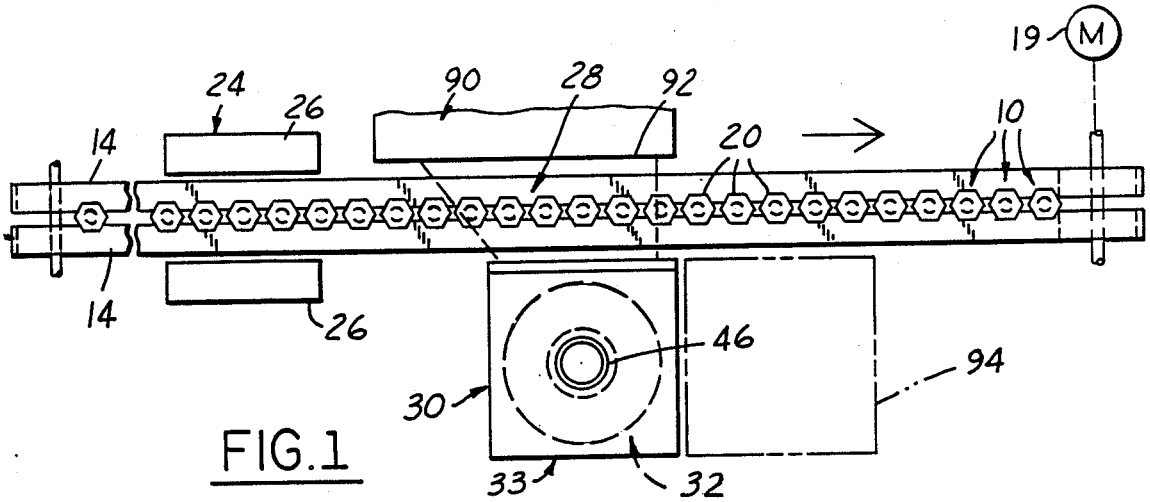
FIG.1
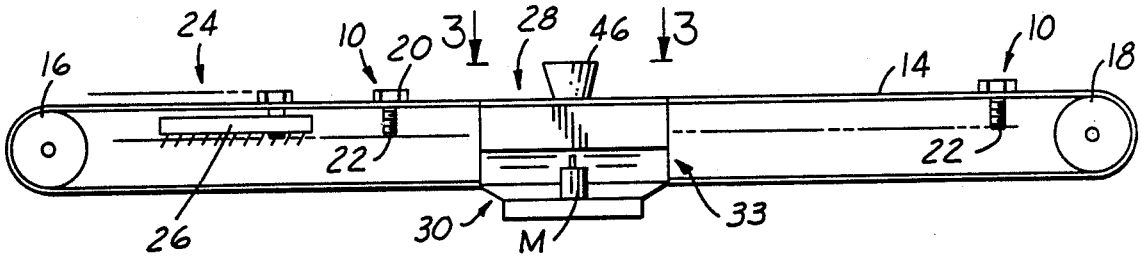
FIG.2
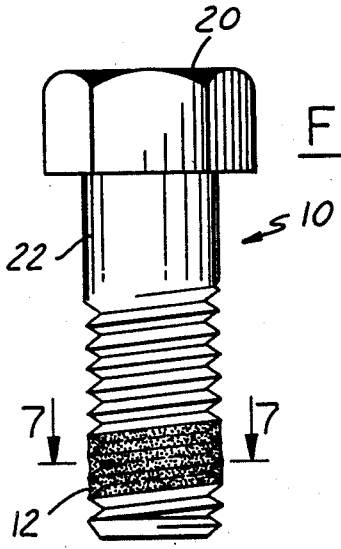
FIG.6
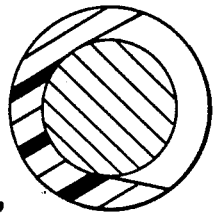
FIG.7
FIG.5
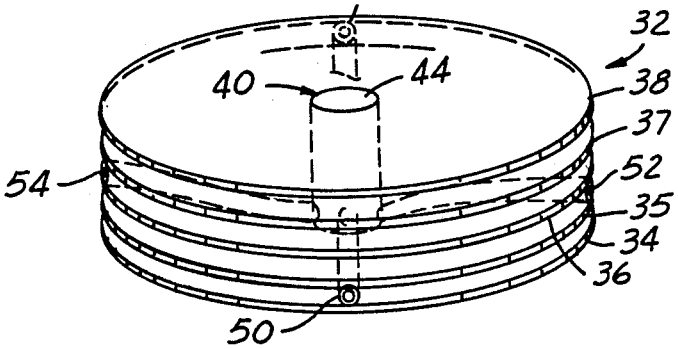

METHOD AND APPARATUS FOR MAKING SELF-LOCKING FASTENERS

This invention relates generally to self-locking fasteners and more particularly to a method and apparatus for applying a locking patch on the threaded surface of a threaded fastener.

BACKGROUND OF THE INVENTION

In accordance with present practice, resin locking patch material is applied to fasteners by passing the fasteners in heated condition through a stream of thermoplastic resin particles or powder carried in a blast of air from a jet nozzle. The powder accumulates on the hot fasteners and fuses into a body or patch of thread locking material. However, the air stream has a chilling effect on the fasteners, increasing production time and energy needed to heat the fasteners. Examples of apparatus for applying patch material to fasteners are shown in U.S. Pats. Nos. 3,498,352; 4,120,993 and 4,508,759.

SUMMARY OF THE INVENTION

It is a principal object of this invention to provide an improved method and apparatus for applying locking patch material on the threaded surface of a fastener by means of a mechanical propelling device which slings or propels the resin particles or powder against the heated threaded surfaces of the fasteners, instead of the air jet nozzles used in the past. The mechanical propelling device may comprise a rotatable slinger adapted to rotate and propel the resin particles by centrifugal force.

In accordance with one embodiment of the invention to be described, a disc-like slinger is provided with a plurality of radially extending tubes the outer ends of which are evenly spaced around the periphery of the slinger. When the slinger is rotated, resin particles admitted to the inner ends of the tubes are slung outwardly in equal amounts through the outer ends of the tubes. The tubes may be distributed at different levels axially of the slinger so that the resin powder material is applied to the fasteners in a broad band.

One of the advantages of the present invention is that it makes it possible to achieve high particle velocity with minimum air flow. Moreover, the resin particles coming out of the tubes have a fan-shaped spread to provide a wide angular flight path and give a fuller angle of wrap of the fused particles on the finished product.

The relatively air-less delivery of resin particles makes it possible to increase the rate of production and reduce heating energy requirements. Since the slinger device is not blowing air, it will not chill the surfaces of the fasteners. Chilling costs a great deal in both time and energy.

These and other objects of the invention will become more apparent as the following description proceeds, especially when considered with the accompanying drawings.

BRIEF DESCRIPTION OF THE DRAWINGS

FIG. 1 is a diagrammatic top plan view of apparatus constructed in accordance with the invention.

FIG. 2 is a side view of the apparatus shown in FIG. 1.

FIG. 5 is a perspective view of the slinger which forms part of the apparatus.

FIG. 6 is a view showing a fastener with a resin patch applied thereto by the apparatus of this invention.

FIG. 7 is a sectional view taken on the line 7—7 in FIG. 6.

DETAILED DESCRIPTION

Figure 3:
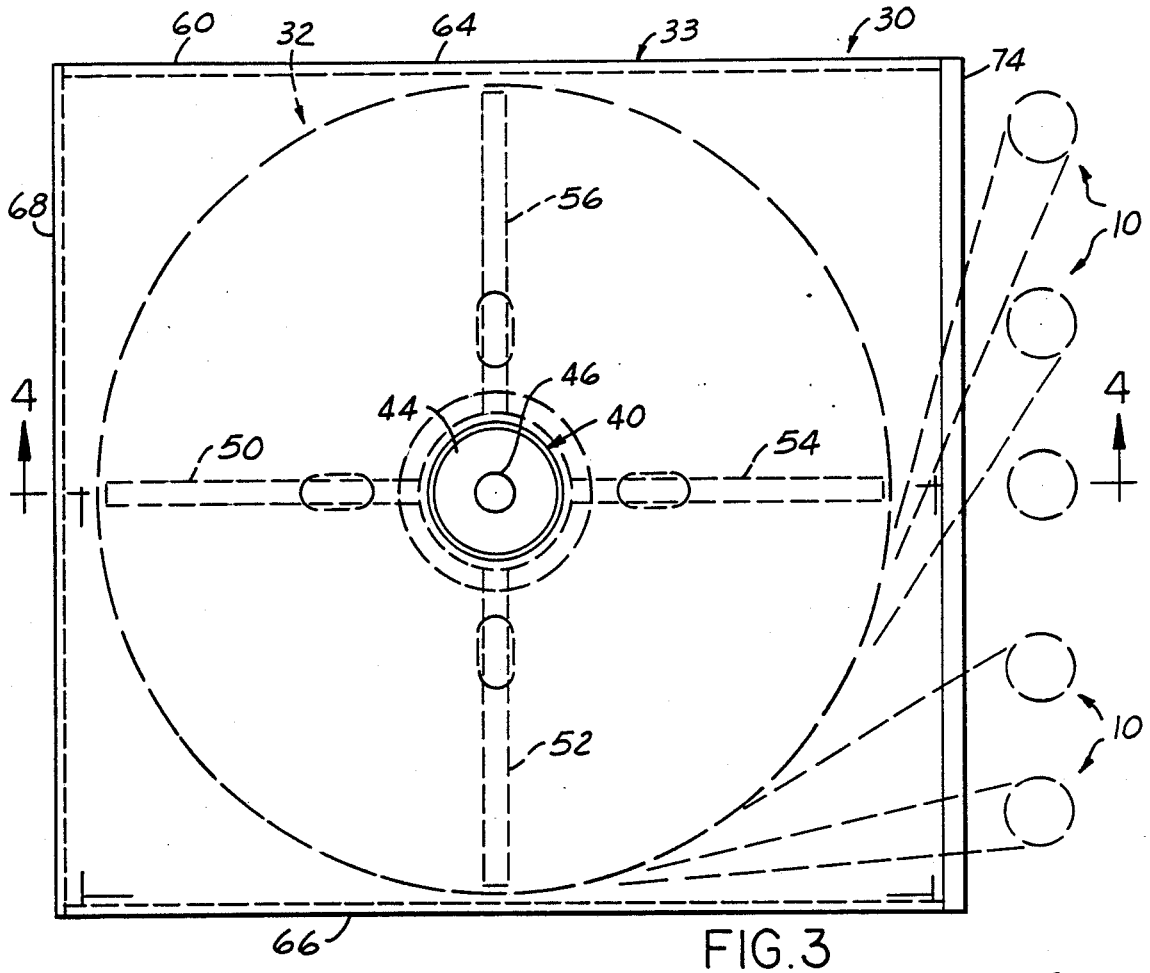
FIG. 3 is an enlarged view of a portion of the apparatus shown in FIG. 1.
Figure 4:
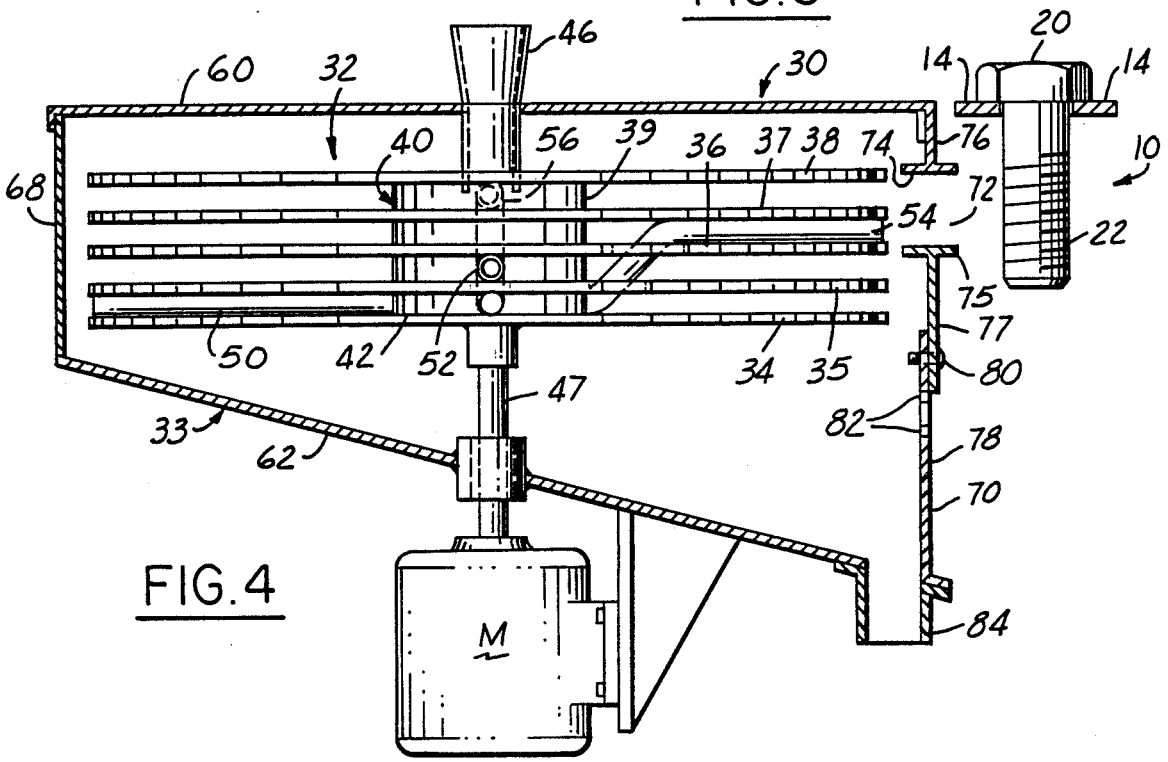
FIG. 4 is a sectional view taken on the line 4—4 in FIG. 3.

This invention will be described in connection with the formation of a self-locking body of resinous material, commonly referred to as a patch, on the threaded shank of an externally threaded article, but it is to be understood that it may be useful also in providing a self-locking patch on an internally threaded article.

A locking type threaded element, here shown as a bolt 10, manufactured according to the present method and by means of the apparatus shown, has a deposit or locking patch 12 of thermoplastic resin material such, for example, as nylon, formed in situ on a selected area of the threaded shank surface by the deposition and melting of fine particles of thermoplastic resin on a heated threaded surface of the fastener. A heat softenable primer (not shown) may be provided to aid in deposition of the plastic particles in the course of manufacture to give superior adhesion between the fastener surface and the patch. The patch 12 covers the valleys, the inclined bearing surfaces and crests of the threaded surface and is so located as to be compressed between the threads of the fastener and mating threads of a complimentary element with which the fastener is assembled to provide increased frictional resistance to undesired loosening of the assembled threaded elements. The process of making the locking type fasteners will be described as it is practiced, using the apparatus diagrammatically shown in the drawings, but it will be understood that other apparatus than that shown may be used.

As shown in the drawings, a succession of threaded fastener elements shown as bolts 10 is conveyed on a carrier in the direction of the arrow in FIG. 1 through the successive steps of the process. The carrier includes spaced parallel endless belts 14 traveling on pulley wheels 16 and 18 driven by a motor 19. The fasteners preferably are suspended in vertical position with portions of the heads 20 resting on the spaced parallel belts and with the shanks 22 depending from the heads beneath the belts and exposed for treatment.

The fasteners are moved through a heating station or zone 24 which could be an oven but is here shown as consisting of induction heater coils 26 designed to heat a succession of the fasteners moving continually past it. As shown, the induction heater coils heat both sides of the fasteners and may be elongated in the direction of movement of the fasteners to heat them to a temperature sufficient to cause the resin particles to melt and fuse when they strike the fastener shanks.

The temperature of the fasteners should be from about 450° F. to about 600° F. at the time of powder contact, assuming the powder is nylon. The reason for the range is that various fastener platings, diameters, thread pitches and desired thickness of patch require varying degrees of "lasting" heat. A small fastener should be heated to a temperature near the high end of the range by the heater coils so that its temperature will still be within the stated range when it gets to the patch application station 28. A larger fastener represents a more lasting heat sink and may move through the process without loosing much of its heat. Therefore, a larger fastener need be heated only to a temperature near the lower end of the range.

From the heating station 24, the fasteners are moved to a patch application station or zone 28 where fine thermoplastic resin particles of nylon or the like are applied by means of the mechanical propelling device 30 positioned to one side of the carrier belts 14.

The propelling device 30 comprises a rotatable slinger 32 in a box or housing 33. The slinger 32 has a plurality of circular, horizontal discs 34, 35, 36, 37 and 38 of equal diameter. The discs are secured in vertically spaced, generally parallel relation to the cylindrical side wall 39 of a cup 40 which extends through the centers of the discs. The cup 40 has a closed bottom wall 42, and provides a well or reservoir 44 for resin powder. The cup 40 is open at the top to permit the reservoir to be supplied with resin powder from a funnel 46. The slinger is rotated by a motor M connected to a vertical shaft 47 which extends downwardly from the center of the bottom of the cup 40.

The slinger has a plurality of tubes 50, 52, 54 and 56. The tubes extend radially outwardly from the axis of rotation of the slinger in equal, angularly spaced relation to each other. The inner end of each tube communicates with the reservoir through a hole in the side wall 39 of the cup near the bottom of the cup between discs 34 and 35. The tube 50 extends radially outwardly in the space between discs 34 and 5. The tube 52 extends from its inner end upwardly through a hole in disc 35 and then radially outwardly between discs 35 and 36. The tube 54 extends from its inner end upwardly through holes in the discs 35 and 36 and then radially outwardly in the space between discs 36 and 37. The tube 56 extends from its inner end upwardly through holes in the discs 35, 36 and 37 and then radially outwardly in the space between discs 37 and 38. The outer ends of the tubes terminate substantially flush with the peripheries of the discs.

The housing 33 has top and bottom walls 60 and 62, side walls 64 and 66, a rear wall 68 and a front wall 70. The funnel 46 may be mounted in an opening in the top wall 60 over the reservoir 44. The front wall 70 of the housing has a slot 72 opposite, or in horizontal alignment with, the shanks 22 of bolts 10 moving on the belts 14. The slot 72 extends for the full width of the housing and is defined by vertically spaced, horizontal flanges 74 and 75. Flange 74 is permanently affixed to the upper front wall portion 76. Flange 75 is permanently affixed to a plate 77 which in turn is secured in selected vertically adjusted positions to the lower front portion 78 by fasteners 80 which engage in any of a vertical series of holes 82 in wall portion 78, thus to vary the vertical dimension, or width, of the slot 72. The width of slot 72 determines the width of the patch to be applied on the bolts 10.

The bottom wall 62 of the housing 33 is sloped downwardly towards the front and has a discharge spout 84 at the lower end for the removal, collection and recirculation of powder which falls to the bottom of the housing. The shaft 47 is journalled for rotation in the bottom wall 62 of the housing.

There is a vacuum powder pick-up unit 90 positioned to the side of the carrier belts 14 opposite the propelling device 30. The vacuum unit 90 has an intake opening 92 which is horizontally aligned with the slot 72 in the propelling device housing 33. Powder which passes between or misses the bolt shanks will be picked up by the vacuum unit for collection and recycling.

As seen in FIG. 1, a second mechanical propelling device 94 may be provided if desired, alongside the propelling device 30, in order to expose the bolt shanks to an extended and uninterrupted powder stream.

In use, the plate 77 on the front wall of the housing is adjusted up or down to control the vertical dimension of the slot 72, depending upon the axial extent of the patch desired to be applied on the bolt shanks. The bolts are loaded on the carrier belts 14 at the left in FIG. 1 and moved by the carrier belts first through the heating station 24 where they are heated to a temperature sufficient to fuse the thermoplastic particles received on the threaded shanks in the application station 28. The bolts continue their movement through the application station 28 where the slinger 32 is located. Powder is dropped continuously into the center well or reservoir 44 and is slung by centrifugal force in equal amounts out of the outer ends of the tubes 50–56 of the slinger 32. The slinger is, of course, rotated at high speed, and the four levels of delivery blend into a single band of powder. Only a portion of the powder may escape the slot 72, depending upon the width of the slot, the remaining powder dropping to the bottom of the box or housing 33. The powder propelled through slot 72 and striking the hot bolt shanks melts and fuses and builds up into a patch 12. The slot 72 restricts the spread of resin particles propelled and limits the application thereof to a predetermined zone on the threaded bolt shanks. It might be noted that if the tubes were not arranged so that their outer ends are positioned at different levels, four in this instance, a single plane of tubes would result in band of powder which might be too narrow for practical use in some instances.

The bolts with applied patches may be collected in any suitable manner at the end of the carrier.

Any air motion generated by the slinger as it rotates is due to laminar drag, and certainly is much less than the airflow incident to the application of the powder in an air stream from a jet nozzle. It is desired to have the least possible airflow and high particle velocity. The fact that the fan-shaped spread of powder coming out of the tubes provides a wide angular flight path for the resin particles gives a fuller angle of wrap of fused powder on the finished product (see FIGS. 3 and 7). This gives a better locking wedge effect when assembled in a mating thread and is preferred over a high narrow ridge of patch material which, while high in projection, is not supported on both sides by an equal volume of patch material. The effectiveness of the patch when in a mating hole is a matter of volume relative to the clearances present, not just its projection at a particular point.

If the parts are rotated while the powder is applied, the patch can be extended circumferentially, even to the extent of forming a band completely around the part. Rotation of the parts may be accomplished by any suitable means such as by causing the belts 14, which support the parts, to travel at different speeds.

The relatively air-less delivery of the resin particles is an important factor in speeding up production and shortening the length of the machine as well as the amount of energy required to heat the parts. Any air moving across the parts having a temperature below the 450° F. to 600° F. temperature of the parts at the time of powder contact will carry off heat from the parts. Since the slinger is not blowing air at the recently heated part, the part will not be chilled. Chilling of the parts increases both production time and energy consumed.

While the slinger is shown as having five discs with one tube in the space between each pair of adjacent discs, clearly the total number of tubes as well as the number of tubes per space and also the number of such spaces may vary as required or desired. The diameter and over-all height of the slinger may vary, depending to some extent upon the size of the parts and number of discs. Typically the slinger will have a diameter in the range of about 2 to 16 inches and an over-all height in the range of about 1/16 of an inch to 3 inches. Good results can be achieved on a ⅜ inch diameter fastener with a slinger diameter of 10 inches and an over-all height of 5/16 of an inch. The speed of the rotation of the slinger may also vary, usually in a range of about 500 to 5,000 rpm, and preferably is about 3400 rpm. However, for smaller than average size parts, the slinger diameter and speed of rotation are usually near the lower ends of the stated ranges. The nylon particle size is usually in a range of 20 to 600 microns.

I claim:

1. Apparatus for making locking threaded fasteners having on the threaded surfaces thereof locking patch material formed by an accumulation of fused thermoplastic resin particles applied thereto, comprising means for advancing a series of fasteners along a predetermined patch through a heating zone followed by an application zone, heating means for heating said fasteners while in said heating zone to a temperature sufficient to fuse thermoplastic resin particles received on the threaded surfaces of said fasteners in said application zone, and means for applying a locking patch of fused thermoplastic resin particles on the heated threaded surfaces of said fasteners as they traverse said application zone, said applying means comprising a mechanical propelling device including a slinger adjacent said predetermined path, means supporting said slinger for rotation, means for supplying thermoplastic resin particles in powder form to said slinger, and means for rotating said slinger to propel said thermoplastic resin particles by centrifugal force against the heated threaded surfaces of said fasteners in said application zone, causing those particles which are received on said heated threaded surfaces to melt and fuse and build up into a locking resin patch.

2. Apparatus as defined in claim 1, wherein said slinger has means providing radially outwardly directed, circumferentially spaced apart resin particle outlets, and a reservoir for resin particles at the axis of rotation of said slinger in communication with said outlets.

3. Apparatus as defined in claim 1, wherein said slinger comprises a plurality of discs disposed in spaced apart, parallel planes at right angles to the axis of rotation of said slinger, means providing a plurality of passages having radially outwardly directed outlets located in the spaces between said discs and arranged in angularly spaced relation to one another and from which resin particles are discharged by centrifugal force during rotation of said slinger, and a reservoir for resin particles at the axis of rotation of said slinger, all of said passages communicating with said reservoir adjacent the bottom thereof.

4. Apparatus as defined in claim 1, including adjustable means providing a slot of variable width between said slinger and said predetermined path through which pass thermoplastic resin particles discharged from said outlets, thereby restricting the spread of resin particles propelled and limiting the application thereof to a predetermined zone on the threaded surfaces of said fasteners.

5. A method of making locking threaded fasteners having on the threaded surfaces thereof locking patch material formed by an accumulation of fused thermoplastic resin particles applied thereto, comprising advancing a series of fasteners along a predetermined path through a heating zone followed by an application zone, heating said fasteners while in said heating zone to a temperature sufficient to fuse thermoplastic resin particles received on the threaded surfaces of said fasteners in said application zone, positioning a rotatable slinger at a point adjacent to said predetermined path, and applying a locking patch of fused thermoplastic resin particles on the heated threaded surfaces of said fasteners as they traverse said application zone by feeding thermoplastic resin particles in powder form to said slinger and rotating said slinger to mechanically propel said thermoplastic resin particles against the heated threaded surfaces of said fasteners in said application zone causing those particles which are received on said heated threaded surfaces to melt and fuse and build up into a locking resin patch.

* * * * *

UNITED STATES PATENT AND TRADEMARK OFFICE

CERTIFICATE OF CORRECTION

PATENT NO. : 4,891,244

DATED : January 2, 1990

INVENTOR(S) : Richard B. Wallace

It is certified that error appears in the above-identified patent and that said Letters Patent is hereby corrected as shown below:

Column 5, line 29, "patch" should be --path--.

Signed and Sealed this

Second Day of October, 1990

*Attest:*

HARRY F. MANBECK, JR.

*Attesting Officer*

*Commissioner of Patents and Trademarks*